United States Patent [19]

Brown, II

[11] Patent Number: 4,606,192

[45] Date of Patent: Aug. 19, 1986

[54] SOLAR POWER GENERATION

[76] Inventor: William G. Brown, II, 720 NW. 31st St., Corvallis, Oreg. 97330

[21] Appl. No.: 765,822

[22] Filed: Aug. 14, 1985

Related U.S. Application Data

[60] Division of Ser. No. 486,087, Apr. 18, 1983, Pat. No. 4,549,604, which is a continuation-in-part of Ser. No. 122,357, Feb. 14, 1980, abandoned, which is a continuation-in-part of Ser. No. 816,501, Jul. 17, 1977, abandoned, which is a continuation-in-part of Ser. No. 788,207, Apr. 18, 1977, abandoned.

[51] Int. Cl.[4] ..... F01K 25/06

[52] U.S. Cl. ..... 60/649; 60/641.8; 60/646

[58] Field of Search ..... 60/641.8, 641.9, 646, 60/649, 657, 673, 689

[56] References Cited

U.S. PATENT DOCUMENTS

| | | | |
|---|---|---|---|
| 327,300 | 9/1885 | Natanson | 62/269 X |
| 2,005,377 | 6/1935 | Kasley | 122/21 |
| 4,122,680 | 10/1978 | Isshiki et al. | 60/649 |
| 4,481,775 | 11/1984 | Beveridge | 60/673 X |

*Primary Examiner*—Stephen F. Husar

[57] ABSTRACT

A solar electric power generating process is described which consists of tapwater thermally contacted with special brine. Low pressure characteristics of the brine draw steam through a power-generating turbine from the water into the brine. As the brine is pumped over an open air evaporator, excess water picked up by the brine is driven off using solar or waste heat. The tapwater is first purified in a demineralizer.

2 Claims, 2 Drawing Figures

SOLAR POWER GENERATION

REFERENCE TO RELATED PATENT APPLICATIONS

The present patent application is a division of U.S. patent application Ser. No. 486,087, entitled SOLAR POWER GENERATION by William G. Brown, filed 18 Apr. 1983, now U.S. Pat. No. 4,549,604, which in turn is a continuation-in-part application of U.S. patent application Ser. No. 122,357, filed 14 Feb. 1980, now abandoned, which in turn is a continuation-in-part of U.S. patent application Ser. No. 816,501, filed 17 July 1977, now abandoned, which in turn is a continuation-in-part of U.S. patent application Ser. No. 788,207, filed 18 Apr. 1977, also now abandoned.

BACKGROUND OF THE INVENTION

The present invention relates to a desiccant absorption power plant using the combination of an open air evaporator and a demineralizer to purify required boiler feedwater.

Kasley (1935), U.S. Pat. No. 2,005,377, describes an absorption power plant using an inexpensive open air evaporator and using tapwater as boiler feedwater. However, his plant preheats water and desiccant brine streams to high temperatures and directly boils water to steam creating serious corrosion and mineral deposit problems which outweight the advantage of the open evaporator. To avoid this corrosion and deposits problem, Isshiki et al., U.S. Pat. No. 4,122,680, describes a low temperature (vacuum) process and Natanson (1885) U.S. Pat. No. 327,300 describes an indirect, flash-boiling process, but neither use the evaporative capacity of air to drive water from liquid desiccant brine in an open cycle and thereby suffer low cycle efficiency and high cost. Features of the present invention described herein make the inexpensive, open evaporator feasible.

The present invention reduces potential for deposits of minerals in the boiler by at least partially demineralizing the feedwater stream (as of calcium and magnesium salts, for example) prior to introduction to the boiler.

SUMMARY OF THE INVENTION

One object of the present invention is to use inexpensive feedwater containing minerals and yet not hinder boiler operation. Another object is to use an inexpensive, long life evaporator for capturing solar or waste heat. Still another object is to exploit the evaporative capacity of air for enriching a desiccant to produce power. Yet another object is to use an inexpensive, benign desiccant brine. Yet another is to operate the boiler system without mineral deposition by removing all or part of the minerals from the feedwater.

BRIEF DESCRIPTION OF DRAWINGS

Other objects and advantages of the present invention will become more apparent from the following detailed description of preferred embodiments thereof and from the attached drawings of which.

DETAILED DESCRIPTION OF PREFERRED EMBODIMENTS

Figure 1:
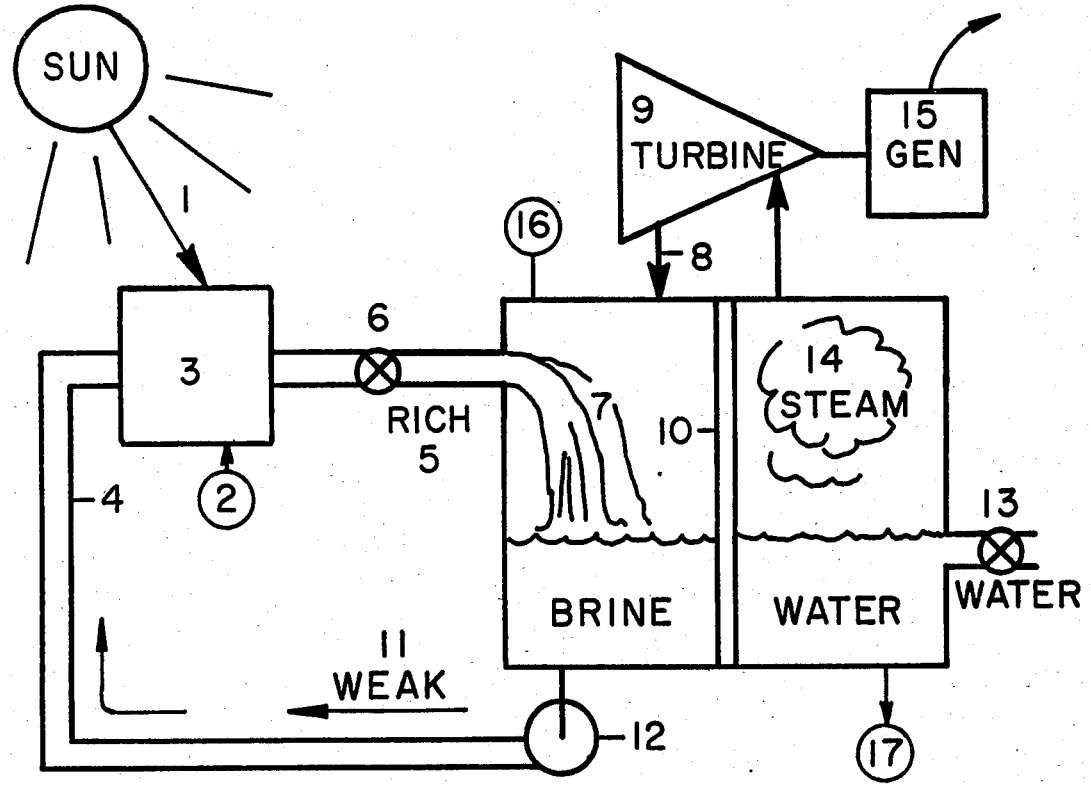
FIG. 1 is a schematic representation of a simplified absorption power plant.

FIG. 1 is a schematic representation of a simplified embodiment of the absorption plant for generating power. Solar energy 1 or waste heat 2 warming the evaporator 3 drives excess water off weakened brine 4 into the open atmosphere producing rich brine 5. Rich brine 5 then advances through valve 6 (designated as a circled X in diagrams) into the vacuum absorber chamber 7. Due to the low pressure characteristics of the brine, low pressure steam 8 is drawn into the brine from the turbine 9. As the brine absorbs the steam, it evolves heat to the heat transfer surface 10 and becomes weakened brine 11 to be pumped 12 back to the evaporator 3 to be recycled again. Meanwhile, a stream of water 13 contacting the heat transfer surface 10 absorbs the heat previously evolved and boils to high pressure steam 14. The steam 14 then flows through the turbine 9 turning the generator 15 to produce electricity. Residual non-condensible gases from the low pressure steam are removed by vacuum pump 16 and accumulated minerals from the water stream through blowdown line 17. The evaporator 3 has the means for providing free access to the atmosphere which for sufficiently dry air eliminates the need for a supplemental heat source entirely, although solar energy would usually be employed. At least half of the water driven off the brine is not recovered but is lost to the earth's atmosphere from the open evaporator as defined in this patent.

Note that the terms "high pressure steam" and "low pressure steam" are relative and that the high pressure steam may actually be at subatmospheric conditions. Note also that the terms "rich desiccant" (the same as "concentrated desiccant") and "weakened desiccant" are relative and that the weakened desiccant may actually be 50% by weight calcium chloride, for example. A concentrated desiccant as defined here has a boiling point elevation of at least 12° C. (it will absorb atmospheric pressure steam at above 112° C.) Water as defined here will boil at less than 105° C. In addition the term "turbine" is meant to include any engine suitable for expanding steam to generate power. Finally, the term stream is not meant to be limited to continuous flow. The stream of water 13, for example, may be intermittent while contact with the surface 10 may be continuous.

Figure 2:
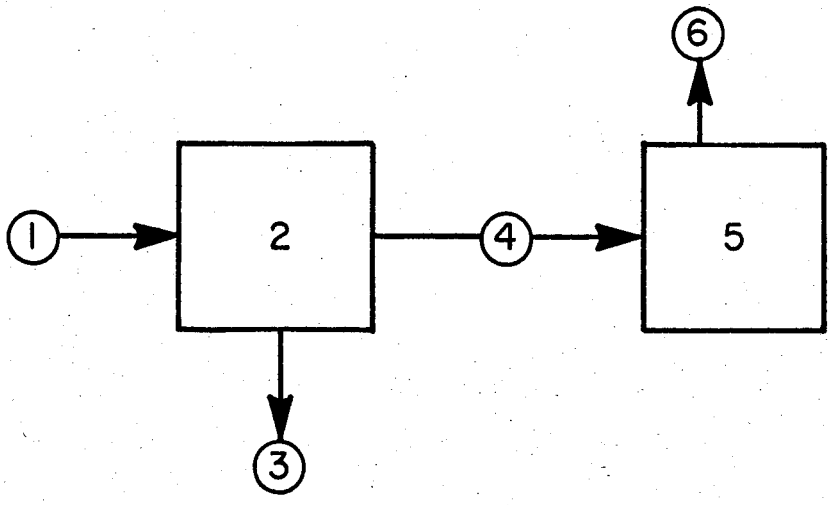
FIG. 2 is a schematic representation of a combination of a demineralizer and an absorption power plant.

FIG. 2 is a schematic representation of a combination of a demineralizer and absorption power plant using an open air evaporator. Water 1 enters the demineralizer 2 where minerals 3 may be totally or selectively removed producing demineralized water 4 as defined here. For example, calcium and magnesium may be partially removed to produce demineralized water to reduce mineral deposition. Other metals, typically sodium and potassium, may be left in solution because they are harmless. By selectively removing minerals, wherein the removed fraction of calcium and magnesium is substantially greater than the removed fraction of other metals, the deposition of minerals may be reduced efficiently. The demineralized feedwater 4 then feeds the absorption power plant producing power 6. The demineralizer 2 may also be remotely located from power plant 5 as for example at the ocean desalinating seawater and feeding the absorption power plant located inland.

It will be obvious to those having skill in the art that many changes may be made in the details of the above preferred embodiments of the invention. Therefore, the scope of the present invention should only be determined by the following claims.

I claim:

1. An absorption power generating process comprising:

demineralizing water to produce feedwater;

injecting low pressure steam into an absorber chamber;

injecting rich desiccant into said absorber chamber;

absorbing at least a portion of said injected low pressure steam into said rich desiccant to release heat from said desiccant and produce a weakened desiccant;

removing at least a portion of said weakened desiccant from said absorber chamber;

evaporating at least a portion of the water from said weakened desiccant into the open atmosphere to enrich said weakened desiccant;

transferring said heat from said absorber chamber into a stream of said feedwater to produce high pressure steam;

expanding said high pressure steam through a turbine to produce power and said low pressure steam.

2. The process according to claim 1 wherein demineralizing said feedwater comprises selectively removing calcium and magnesium from said feedwater such that the fraction of calcium and magnesium removed from said feedwater is substantially greater than the fraction of other metals removed from said feedwater.

* * * * *